United States Patent [19]

Splaine

[11] Patent Number: 4,705,141

[45] Date of Patent: Nov. 10, 1987

[54] COMPACT FIRE ESCAPE

[76] Inventor: Constance K. Splaine, 69 Elm St., Danvers, Mass. 01923

[21] Appl. No.: 787,318

[22] Filed: Oct. 15, 1985

[51] Int. Cl.[4] ..... A62B 1/20

[52] U.S. Cl. ..... 182/48; 182/100

[58] Field of Search ..... 182/48, 49, 5, 100, 182/189

[56] References Cited

U.S. PATENT DOCUMENTS

| | | | |
|---|---|---|---|
| 217,142 | 7/1879 | Pfefferle | 182/48 |
| 287,491 | 10/1883 | Woodward | 182/5 |
| 291,319 | 1/1884 | Fischer | 182/49 |
| 495,955 | 4/1893 | Bouvier | 182/48 |
| 653,498 | 7/1900 | Barnett | 182/48 |
| 672,623 | 4/1901 | Jennings | 182/48 |
| 3,348,630 | 10/1967 | Yamamoto | 182/48 |
| 3,580,358 | 5/1971 | Yamamoto | 182/48 |
| 3,977,495 | 8/1976 | Zephinie | 182/48 |
| 4,005,762 | 2/1977 | Zephinie | 182/48 |
| 4,398,621 | 8/1983 | Baker | 182/48 |

*Primary Examiner*—Reinaldo P. Machado
*Attorney, Agent, or Firm*—Thomas C. Stover

[57] ABSTRACT

A fire escape in the form of a flexible mesh tube attached to a frame which is sized to permit passage of a human therethrough is provided. A rope extends at least partially through the tube and is contacted by a rope engaging member which is securable to a person in transit in the tube so as to guide his descent therein along the rope. Desirably, the tube is relatively small in cross-section but elastic, to frictionally engage the person descending therethrough to slow his descent. The fire escape tube telescopes to a compact package for storing next to a window in an upper story of a building.

7 Claims, 10 Drawing Figures

COMPACT FIRE ESCAPE

BACKGROUND OF THE INVENTION

1. Field of the Invention

This invention relates to a tubular fire escape, particularly a flexible tubular fire escape.

2. The Prior Art

Flexible tubular fire escapes for tall buildings are known. See for examples U.S. Pat. No. 3,348,630 to Yamamoto (1967), U.S. Pat. No. 4,005,762 to Zephinie (1977) and U.S. Pat. No. 4,398,621 to Baker (1983). In the Yamamoto reference one descends in a constricted tube with no rope to hang onto. In Zephinie, one descends in an elastic tube holding onto a pre-tensioned ladder or cable which acts as an elevator and Baker discloses a tubular mesh descent tube in which no internal rope is provided, as the user must descend by means of his hands engaging the mesh. Thus, of these references, only Zephinie provides an internal cable and this is pre-tensioned around pulleys to act as an elevator. Such cable has a series of knots therein to be grabbed by the person descending therewith, as shown in FIG. 9.

Accordingly, no flexible fire escape tube is provided having an uncomplicated guide filament therein by which controlled descent may be made within such tube relative to such filament and tube and there is a need and market for a fire escape tube that substantially overcomes the above prior art shortcomings.

There has now been discovered a fire escape tube of uncomplex construction that permits controlled descent therein along a guide filament and yet telescopes into a compact package for storing and quickly extends when needed e.g. out the window of a tall building.

SUMMARY

The invention will become more apparent from the following detailed Specification and drawings in which:

FIG. 1 is an elevation view of the escape tube embodying the present invention;

FIG. 2 is a further elevation view of the escape tube of FIG. 1;

FIGS. 3, 4 and 5 are elevation views of another escape tube embodying the invention;

FIG. 6 is a sectional elevation view of the escape tube of FIGS. 1 and 2 in use;

FIG. 7 is a fragmentary elevation view of another component of the escape tube of FIG. 6, and FIGS. 8, 9 and 10 are fragmentary elevation views of a portion of the escape tube components of FIG. 6.

BRIEF DESCRIPTION OF THE DRAWINGS

Referring in more detail to the drawings, escape assembly 10, has tube 11 (e.g. of wire mesh in compact form) with rope or cable 14 therein, which tube and rope are both mounted to frame 18 for placement on and through window 12 of a tall building 15, as shown in FIGS. 1 and 2. When a fire is detected, the window 12 is opened, the escape frame 18 is positioned against the open window and the tube 11 is pushed out the window 12 where it and its interior cable 14 de-telescope or fall toward the ground (or other support surface), as shown in FIG. 2. The rope or cable 14 within the tube 11, falls toward the ground with it and serves as a hand-hold for the user of such chute or tube 11 in escaping from a building.

The frame 18 can have tabs 9 which engages the window sides and desirably rests on the sill thereof and has legs 19 and a tab 17 which engage the top and bottom of the open window so as to anchor the frame 18 in place per FIGS. 1 and 2.

Figure 1:
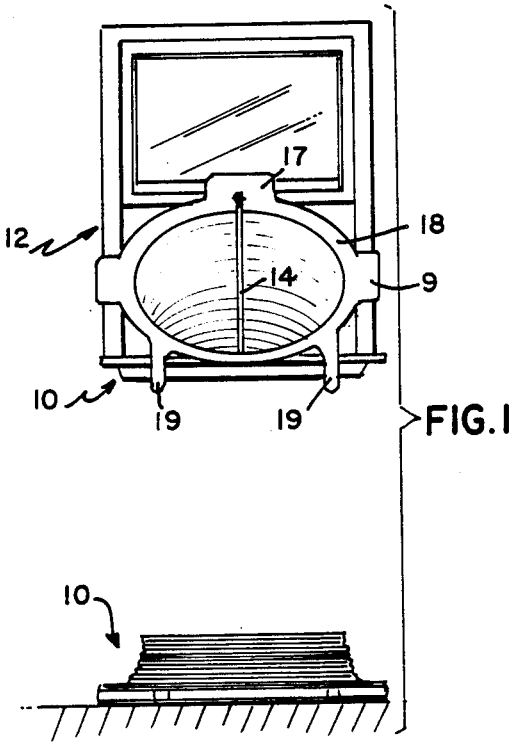
Figure 2:
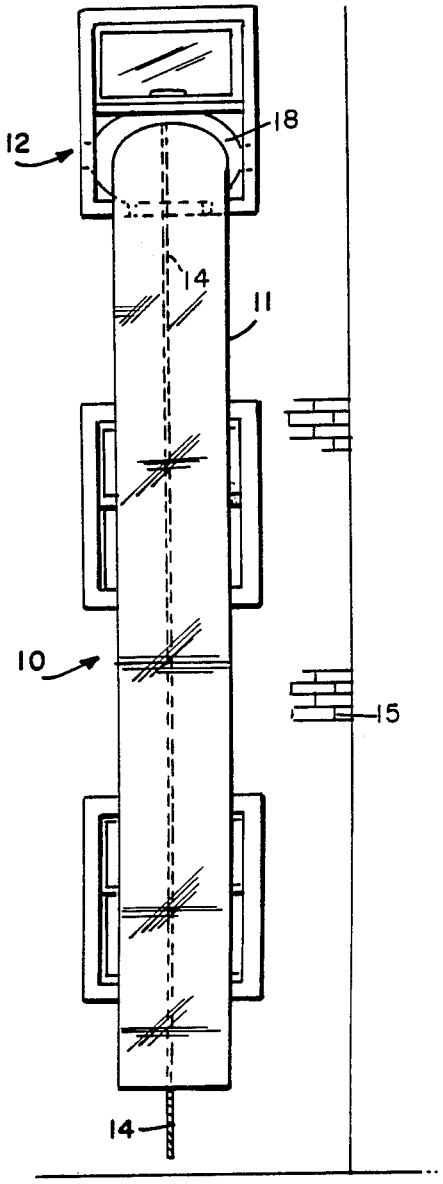
Figure 3:
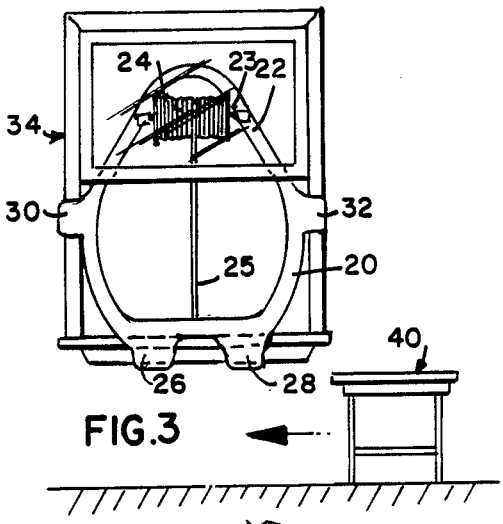
Figure 4:
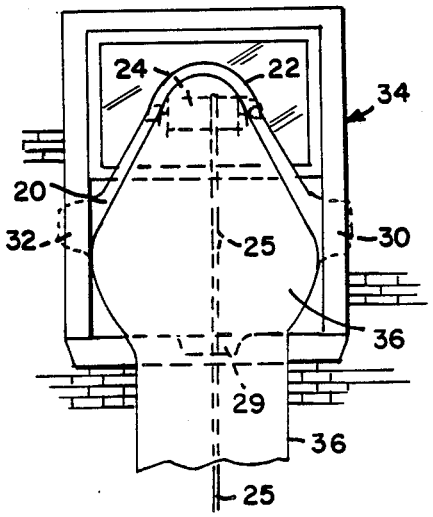
Figure 5:
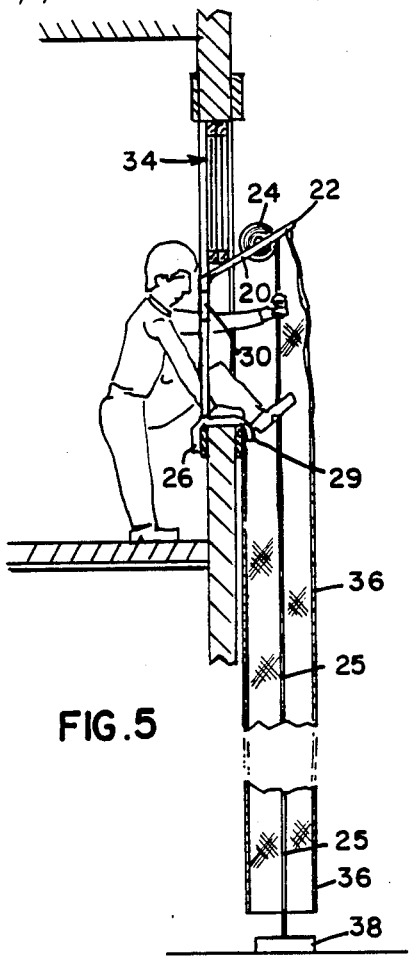

In another embodiment, an oblong frame 20 having projecting arc 22, rope coil 24 and rope 25 mounted on spindle 23, along with feet 26 and 28 and outside feet 29 and arms 30 and 32, is mounted in window 34, as shown in FIGS. 3, 4 and 5. The tube mesh 36 is attached to the frame 20 and the tube 36 and interior rope 25 lower from the window 34, as shown in FIGS. 3, 4 and 5. Additionally, a landing pad 38 can be attached to the lower portion of the rope 25, as shown in FIG. 5. A table 40 shown in FIG. 3, can be positioned proximate the window 34 to assist entry into the frame 20, as desired.

Figure 6:
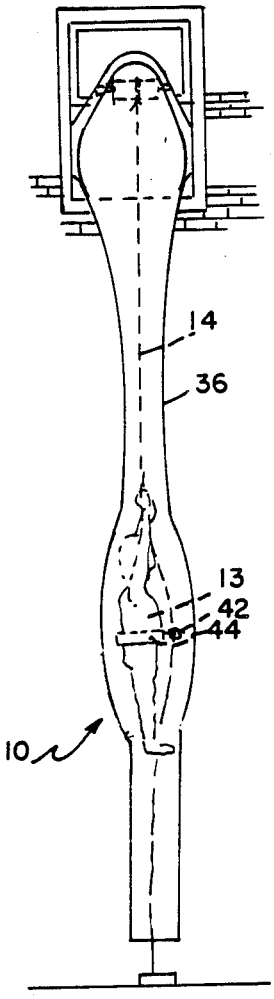
Figure 7:
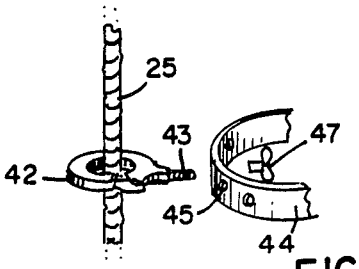

In a further embodiment, the tube upon being lowered toward the ground contracts in cross-section to form a friction fit with the user 13 who may descend, holding the rope 25 e.g. per FIG. 6, the friction fit slowing the descent of the user 13 as does his grip on the interior rope or cable 25.

Alternatively, the chute or tube 10 can be sufficiently large in diameter relative to the person descending therein so that little or no friction fit occurs and he descends hand over hand on the rope 25.

However, the friction fit model is the preferred embodiment, particularly for those people who are less athletic or those who feel safer descending in a close fitting tube.

Figure 8:
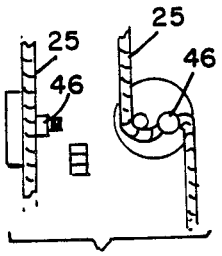
Figure 9:
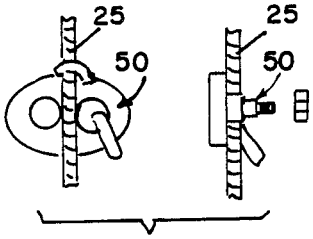
Figure 10:
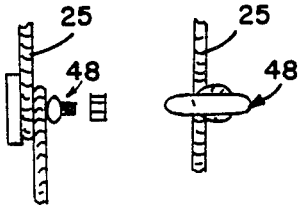

To further enchance the descent of the user, a rope or cable engaging element 42 can be provided which engages the rope or cable 25 and also the clothing of the user e.g. his belt 44, e.g. the threaded portion 43 [of the element 42] passes through belt aperture 45 and is secured thereto by turning wing nut 47, as shown or indicated in FIGS. 3 and 5. The rope engaging element can be a shackle, cinch, cleat or jam cleat or similar element, as desired. For example, the element can be a cleat 46 per FIG. 8; a jam cleat 50 per FIG. 9 or a single cleat 48 per FIG. 10. Where a cleat or jam cleat, such element controls the rate of guide rope or cable passing therethrough and the user, by tightening the cinch or jam cleat, can slow or stop as he descends in the tube along the guide rope or cable, to permit a controlled descent in such escape tube, as shown dor indicated in FIGS. 6 to 10.

Accordingly, the escape tube of the invention is readily reduced to a compact package weight e.g. 50 lbs. which can be stored on an upper floor of a building, such as a hotel room next to a window, and can be quickly cast through such window where it descends or de-telescopes to the ground, as discussed above.

The escape tube is formed of mesh of e.g. wire, plastic or rope and is elastic or expandable in the cross-sectional or transverse direction, but preferably is substantially non-elastic in the longitudinal or axial direction and is of diameter smaller than the adult person so as to provide a friction fit for such user as he descends therein, as guided by his contact with the filament therein, e.g. rope or cable.

The rope can be made of the same materials as the escape tube and preferably is of plastic e.g. nylon to reduce possible friction burns on the hands of the user.

The rope engaging member, as indicated above, can be a shackle, cinch, jam cleat, basic cleat, ring or other rope engaging device which maintains the descent filament in close proximity to the user to assist his controlled descent there-along.

The filament should be considerable longer than the tube in the event that if the tube is not long enough to reach the ground, the filament will reach at least proximate thereto.

What is claimed is:

1. A fire escape comprising, a portal frame, said frame having an upper portion which projects forward of the lower portion of said portal frame, a descent filament mounted to an outer part of said upper portion, a flexible woven tube attached at the inner side thereof to said frame at said lower portion and attached at the outer side thereof to said frame at said upper portion, sized to permit passage of a person therethrough, said filament being held by said outer part outwardly of the inner side of said tube and extending at least partially through said tube.

2. The fire escape of claim 1 wherein said tube is relatively small in cross-section but is elastic to frictionally engage the person descending therethrough to slow his descent.

3. The fire escape of claim 1 having a filament engaging member which is securable to a person in transit in said tube and said filament engaging member is a cleat or cinch which can releasably engage said filament to permit a controlled descent through said tube.

4. The fire escape of claim 1 wherein said tube is made of mesh material selected from the group consisting of, wire, rope or plastic.

5. The fire escape of claim 1 wherein said tube is of sufficiently large cross-section to permit a person to descend therethrough on said filament with clearance.

6. The fire escape of claim 1 wherein said tube telescopes to a compact package for storing next to a window in an upper story of a building.

7. The fire escape of claim 1, wherein said frame has projections extending therefrom which engage the sides of an open window to anchor said frame in place, the upper portion of said frame projecting forward and outside of said window.

* * * * *